United States Patent [19]

Hall, III et al.

[11] 4,241,549

[45] Dec. 30, 1980

[54] CONJOINT FACIA, FLASHING AND WATER DAM

[75] Inventors: James H. Hall, III; Julian J. Attaway, both of Tucker, Ga.

[73] Assignee: MM Systems Corporation, Tucker, Ga.

[21] Appl. No.: 940,339

[22] Filed: Sep. 7, 1978

Related U.S. Application Data

[63] Continuation of Ser. No. 831,976, Sep. 9, 1977, abandoned.

[51] Int. Cl.[2] ..... E04D 13/15

[52] U.S. Cl. ..... 52/60; 52/94; 52/97

[58] Field of Search ..... 52/94, 95, 97, 60, 573

[56] References Cited

U.S. PATENT DOCUMENTS

| | | | |
|---|---|---|---|
| 3,012,376 | 12/1961 | Reddy | 52/97 |
| 3,100,951 | 8/1963 | Hickman | 52/60 |
| 3,571,992 | 3/1971 | Comiskey | 52/94 |
| 3,585,766 | 6/1971 | Jamieson | 52/60 |
| 3,766,694 | 10/1973 | Minialof | 52/95 |
| 4,037,372 | 7/1977 | Patry | 52/573 |
| 4,071,987 | 2/1978 | Hickman | 52/94 |

FOREIGN PATENT DOCUMENTS

| | | | |
|---|---|---|---|
| 2028965 | 12/1971 | Fed. Rep. of Germany | 52/96 |
| 2060292 | 6/1972 | Fed. Rep. of Germany | 52/60 |
| 2224287 | 11/1973 | Fed. Rep. of Germany | 52/96 |

*Primary Examiner*—John E. Murtagh

*Attorney, Agent, or Firm*—John B. Armentrout

[57] ABSTRACT

A conjoint facia, flashing and water dam for use as a roof deck appurtenance is provided and includes dam means, and facia and flashing means, together contributing means having normally upper longitudinal laterally entrant grooved structure and normally upper longitudinally laterally projecting tongue means which are engaged for stabilizing the facia and flashing means horizontally, while upward thrust for maintaining the facia and flashing means in an installed position is transmitted by flashing means reactively upon exerting pressure upon a roofing sheet on the dam means, with facia means of the facia and flashing means being anchored. In certain embodiments, a portion of the roofing sheet is entrapped between the aforementioned mated tongue means and grooved structure, and in embodiments which are preferred, the facia and flashing means includes a facia and flashing component, or components, wherein facia, flashing and engagable means are formed integrally with one another along with the upper longitudinal laterally entrant grooved structure for each of the facia, flashing and engagable means to be installed and detained at the engagable means as a unit, this with having the dam means include upper longitudinal laterally projecting tongue means for entering the grooved structure.

12 Claims, 5 Drawing Figures

CONJOINT FACIA, FLASHING AND WATER DAM

This is a continuation of application Ser. No. 831,976, filed Sept. 9, 1977 now abandoned.

The present invention relates to building structures and is more particularly concerned with conjoint facia, flashing and water dam means for use adjacent to a juncture of a building roof deck and wall.

An object of the present invention is the provision of a conjoint facia, flashing and water dam which is well suited for being commercially produced, and can be readily installed, thereafter being characterized by horizontal lateral stability of facia and flashing means through engagement of the facia and flashing means with dam means at upper portions of both of these means.

Another object of this invention, in accordance with certain embodiments thereof, is to achieve a conjoint facia, flashing and water dam wherein engagement of facia and flashing means with dam means, to impart horizontal lateral stability to the facia and flashing means, is had with a tongue and grooved slip connection, which allows depression of the facia means of the facia and flashing means into a position wherein the facia means is ready to be raised for being engaged and allows upward reactive thrust from the flashing means to raise the facia means until the facia and flashing means reaches an installed position wherein the facia means is engaged and is still biased upwardly by reactive thrust from the flashing means.

A further object of this invention, in accordance with certain embodiments thereof, is to provide a conjoint facia, flashing and water dam of the character indicated wherein engagement of the facia and flashing means with the dam means is achieved through roofing sheet means by entrapping a portion of the roofing sheet means in a tongue and grooved slip connection.

Other objects of the present invention in part will be obvious and in part pointed out more fully hereinafter.

As conducive to a clearer understanding of certain features of the present invention, the practice of having a conjoint facia, flashing and water dam in association with a deck roof, which usually is either flat or of substantially low pitch, is favored in the architectual and construction fields, for controlling against spilling of roof water over the brink of the deck and thence downward along the building side wall structure below the roof. A conjoint facia, flashing and water dam accordingly used may also serve as a barrier for other material on the deck such as gravel, thus to be a water and gravel stop. Further, beneficially, a conjoint facia, flashing and water dam affords flashing over a sheet roofing end raised from the roof deck onto a surface of a dam means and affords facia outside an outer side of the dam means and adjacent to an outer face of the building wall. A roof water drainage system including one or more suitable water drains and pipelines therefrom usually is installed on the roof deck thus to shed water such as by gravity feed to a lower location.

In accordance with the present invention, a conjoint facia, flashing and water dam for use at juncture of a building wall and roof deck is introduced wherein dam means, and facia and flashing means including facia means and flashing means, contribute means having normally upper longitudinal laterally entrant grooved structure, and normally upper longitudinal laterally projecting tongue means for being engaged with the longitudinal laterally entrant grooved structure and stabilizing the facia and flashing means horizontally both laterally outwardly and inwardly with reference to the building wall while outer side means of the dam means is covered by the facia means adjacent to an outer face of the building wall.

With the dam means installed on a roof deck adjacent to a juncture of the roof deck and the building wall, the features are such that sheet roofing leading upward on a surface of the dam means from the roof deck, and extending under the flashing means, is pressed against that surface of the dam means by the flashing means, and the flashing means reactively biases the facia means in an upward direction when the facia and flashing means is in an installed position wherein the facia means is detained against upward movement by engageable means of the facia means being engaged with detent means normally lower than the aforementioned engaged upper longitudinal laterally projecting tongue means and longitudinal laterally entrant grooved structure, having the detent means connected with the building. Meanwhile, the mating normally upper longitudinal laterally projecting tongue means and longitudinal laterally entrant grooved structure stabilize the facia and flashing means laterally both horizontally outwardly and inwardly with reference to the building wall.

To facilitate installation of the facia and flashing means, the normally upper longitudinal laterally projecting tongue means, and the normally upper laterally entrant grooved means, are relatively movable after being initially mated, for the engageable means of the facia means to be engaged with the detent means by first lowering the facia means and having the upper longitudinal laterally projecting tongue means and the upper longitudinal laterally entrant grooved means relatively move while still mated, for the engageable means of the facia means thus to be aligned with the detent means in a position normally below the detent means. Concurrently with the foregoing operation, the flashing means is urged downwardly by movement of the facia and flashing means and presses sheet roofing against the surface of the dam means, thereby developing an upward reactive thrust, which is afforded by resilience of the flashing means developed by downward pressure applied to the roofing by the flashing means. Upon thereafter allowing the flashing means to react upon the facia means in an upward direction and thus allowing the upper longitudinal laterally projecting tongue means and the upper longitudinal laterally entrant grooved means, mated therewith, to move relatively to one another, the engageable means of the facia means engages the detent means and accordingly stops the upward movement when the installed position of the facia and flashing means is reached. In the latter position the flashing means transmits thrust to the facia means for maintaining the engageable means of the facia means engaged with the detent means while the upper longitudinal laterally projecting tongue means mated with the upper longitudinal laterally entrant grooved structure stabilizes the facia and flashing means horizontally laterally inwardly and outwardly with reference to the building wall.

In certain embodiments of the present invention, the normally upper longitudinal laterally projecting tongue means and the upper longitudinal laterally entrant grooved structure are adapted to mate with one another while entrapping between their tongue and groove forming members a portion of the sheet roofing and accordingly closing laterally against the entrapped portion of the roofing end. Under the latter conditions, the groove forming means of the longitudinal laterally entrant grooved structure receives a portion of the sheet roofing in a longitudinal laterally entrant groove or grooves therein along with a tongue or tongues of the longitudinal laterally projecting tongue means for the tongue or tongues of the latter means to press the entrapped portion of the sheet roofing into the groove or grooves and the entrapped portion of the sheet roofing to effect a seal against the tongue and groove forming members. In this, the upper longitudinal laterally projecting tongue means and the upper longitudinal laterally entrant grooved structure maintain their relative mobility for the facia and flashing means to be installed upon the dam means, accordingly having the sheet roofing portion entrapped between the tongue and groove forming members while the engageable means of the facia means is being moved to engage the detent means, and after the facia and flashing means is in the installed position on the cant means with the tongue and groove forming members sealed against the entrapped portion of the sheet roofing.

In preferred embodiments of the present invention, the facia and flashing means includes a facia and flashing component, or a plurality of facia and flashing components to be end to end longitudinally, wherein the facia and flashing component is characterized by facia, flashing and engageable members which are formed integrally with one another along with upper longitudinal laterally entrant grooved structure of a type hereinbefore described, for the facia and flashing component to be installed as a unit having the upper longitudinal laterally entrant grooved structure mate with upper longitudinal laterally projecting tongue means of the dam means and have the engageable members engaged with the detent means, as will be further understood from description in further particular hereinafter.

In the accompanying drawings wherein several embodiments of the present invention are represented:

Figure 4:
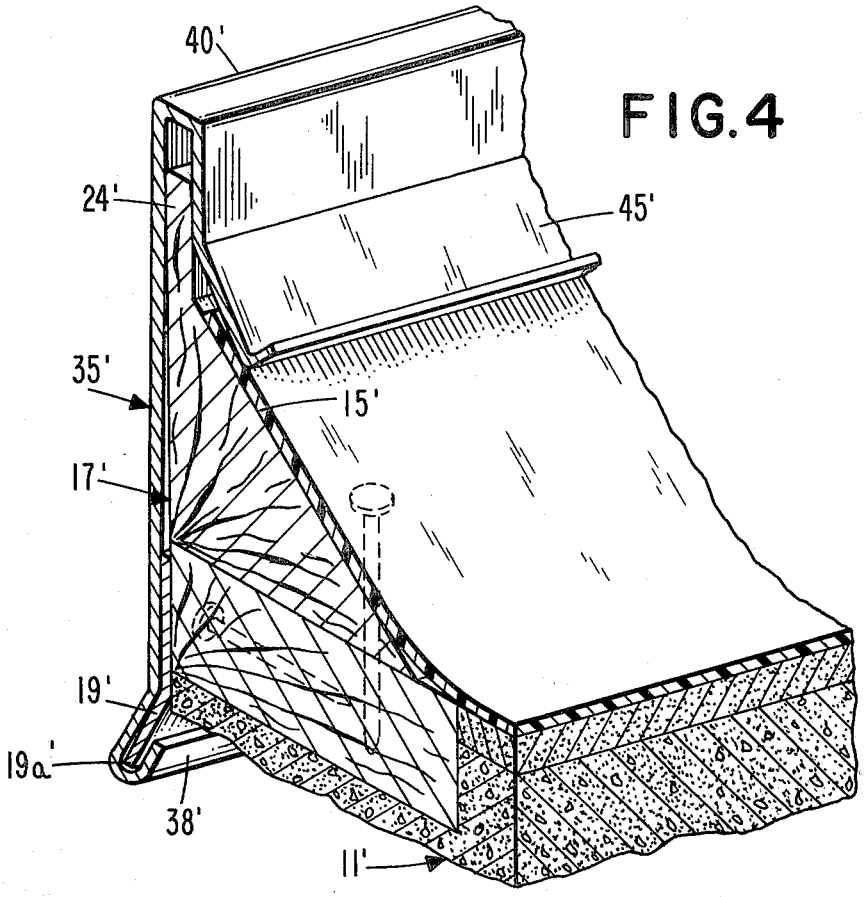
Figure 5:
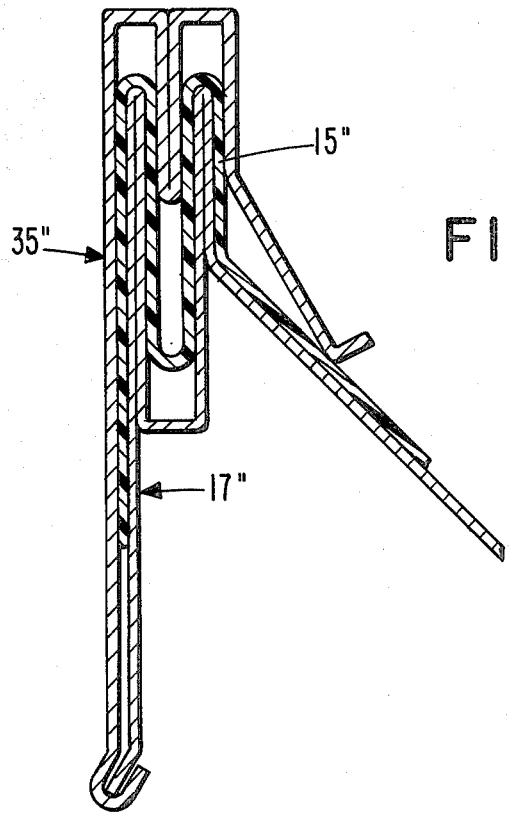

FIG. 4 is a vertical transverse sectional view representing a modified conjoint facia, flashing and water dam still in accordance with this invention; and FIG. 5 is a vertical transverse sectional detail representing a modified form of tongue and grooved horizontally laterally stabilizing connection at the longitudinal ridge structures of facia and flashing member and dam or cant member in accordance with the present invention.

Figure 1:
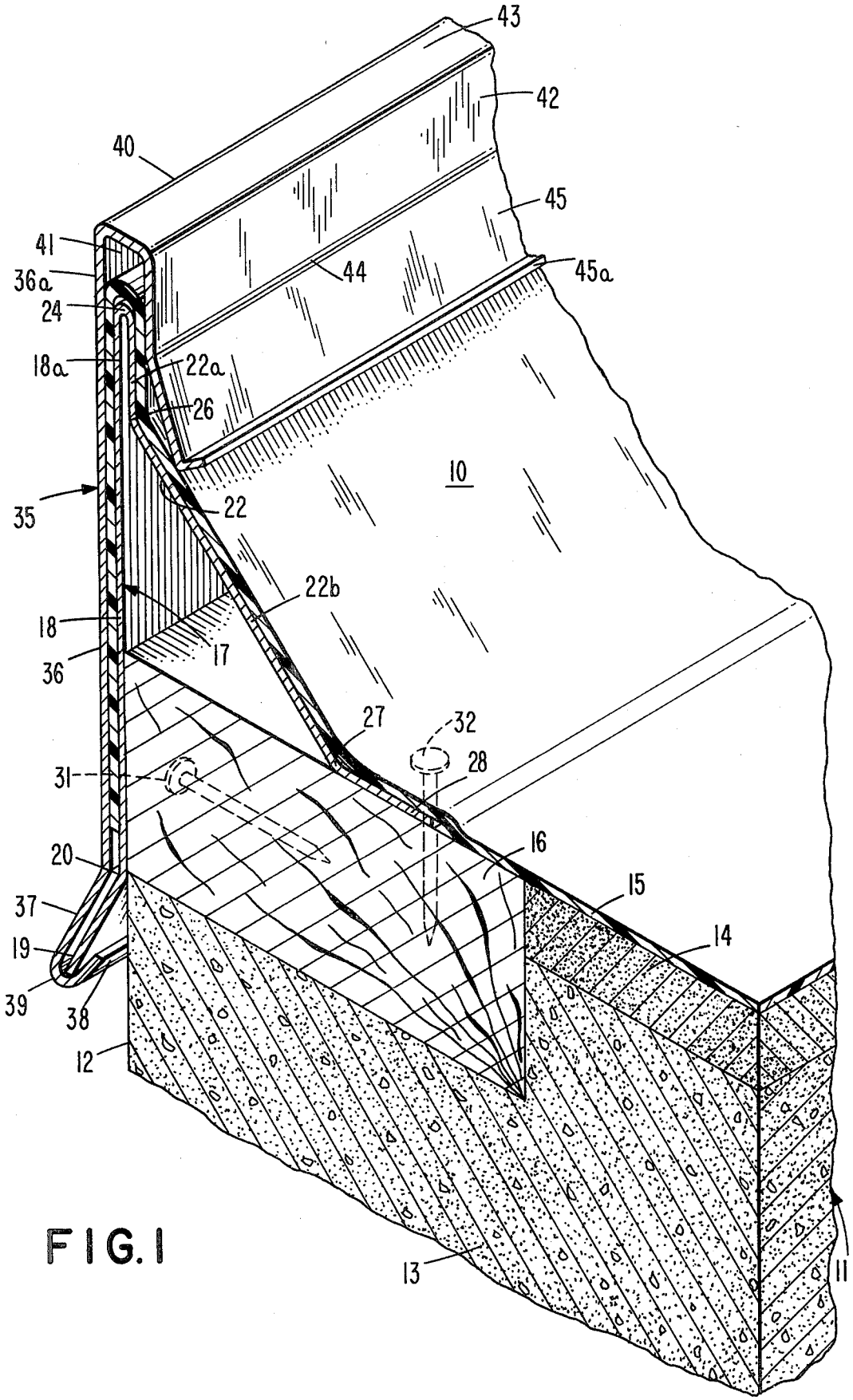
FIG. 1 is a broken away isometric view, frontally in vertical transverse cross section, of a conjoint facia, flashing and water dam and of a roof deck and sheet roofing with which the conjoint facia, flashing and water dam is associated.
Figure 2:
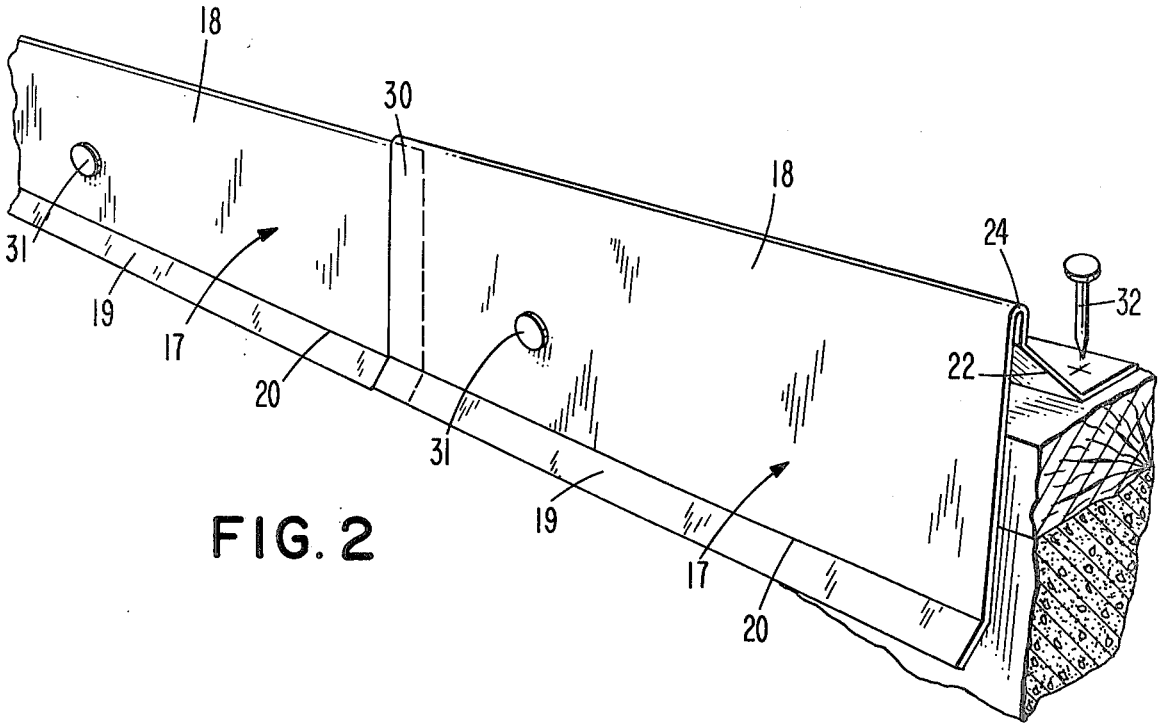
FIG. 2 is a perspective fragmental view representing portions of a pair of dam or cant members of FIG. 1, and also shows a lap joint formed by the pair of those members.
Figure 3:
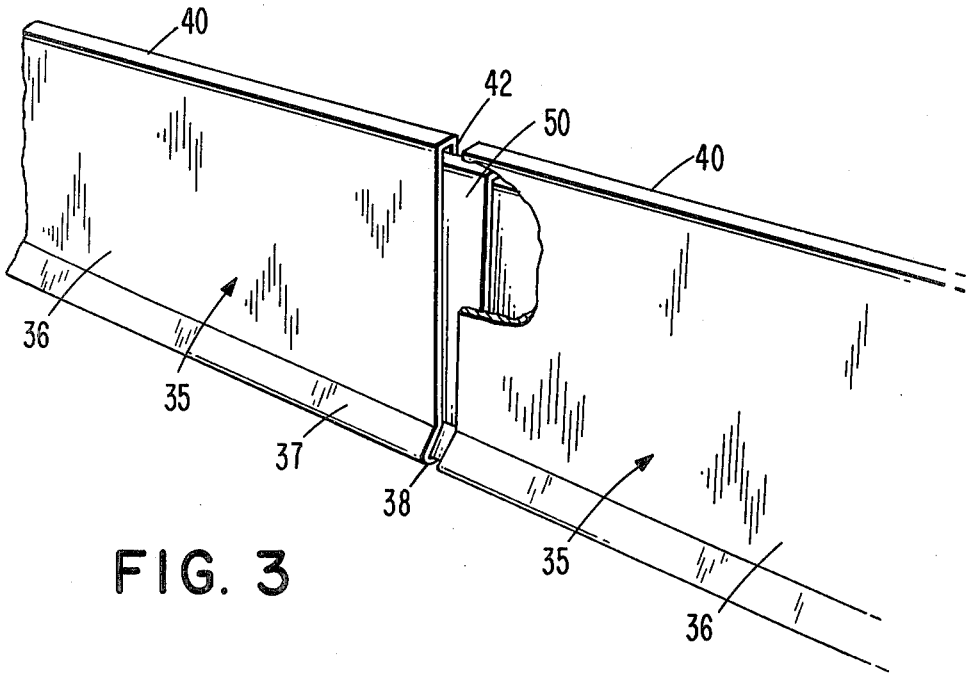
FIG. 3 is a broken away perspective view of a pair of facia and flashing members of FIG. 1 and also represents a splice connection for those members.

In the embodiment represented in FIGS. 1 to 3 of the drawings, a conjoint facia, flashing and water dam 10, to be described herein with reference to a particular installation, is associated with a building roof deck 11 and with the outside wall 12 of this same building, at the edge of the roof deck, the outside wall being one which is trimmed by facia afforded by the conjoint facia, flashing and water dam 10. Roof deck 11 is one that is substantially horizontal and is inclusive of a concrete slab 13 serving as a bed upon which a roofing mixture 14 is supported. A wooden strip means 16 is securely at the edge of the roof deck 11, next to the outside wall 12 of the building. The roofing mixture 14 is leveled flush with the top side of this wooden strip means and is covered at least at the border of the deck next to the conjoint facia, flashing and water dam 10 by sheet roofing 15.

Cant or dam means of the conjoint facia, flashing and water dam 10, in the form represented in FIG. 2, includes a pair of cant or dam members 17, similar in transverse cross section and having adjacent longitudinal ends lapped, as at 30, for these members longitudinally to be in prolongation of one another. In certain installations, of course, only a single member 17 need be used, or more than two such members in tandem are installed as occasion may demand. Each member 17 is characterized by being fashioned from sheet material such as galvanized steel or aluminum base alloy sheet, and includes a normally generally vertical flat front panel 18 having downwardly and outwardly projecting detent means integral therewith in the form of flange means 19 extending from an arris 20 which leads longitudinally of the member 17. The generally vertical front panel 18 and an angular rear panel 22 of the dam member 17 are integral at the crest of a ridge which is produced by a longitudinal laterally generally vertically directed tongue 24 and is substantially parallel at the crest thereof to the arris 20. The tongue 24 has for sides a flat generally vertical upper portion **18*a* of the front panel 18 and a flat upper section 22*a* of the angular rear panel 22, the latter section being substantially parallel with the vertical upper portion 18*a* of the front panel and being integral therewith at the crest or ridge of the dam member 17. A flat, canted lower panel section 22*b* sloping downwardly and rearwardly from an arris 26 to an arris 27 of the dam member 17 is integral with the upper rear section 22*a* at arris 26 and is integral with connective means 28, suitably in the form of a substantially horizontal flange. The arrises 20, 26 and 27 are approximately parallel with the longitudinal ridge crest line produced by the tongue 24, the latter crest line of the cant or dam member 17 also being substantially parallel to the plane of the roof deck 11 after the member 17 has been installed. Installation is readily accomplished by fastener means; suitably, headed nails or screws 31 and 32 applied through the front panel 18 and through the rear connective means 28 into the aforementioned wooden strip means 16 on the roof deck 11. The sheet roofing 15 heads up from the roof deck 11 and is laid upon the dam members 17 to cover the angular rear panels 22 up to the ridge of the tongues 24 and thence extends to cover the front panels 18 of those members, such as progressions to locations opposite the wooden strip means 16 into which suitable fastener means such as nails (not shown) may be driven to secure the sheet roofing 15 to the nailing strip 16 through the front panels 18 of the members 17**.

The dam means 17 in the conjoint facia, flashing and water dam 10 is sheathed frontally and rearwardly by one or more facia and flashing members 35; two such members, similar in transverse cross section, being represented in a longitudinal end to end relation in FIG. 3 for covering the dam means on the length of the latter to a similar longitudinal extent. Each of the facia and flashing members 35 is made of sheet material such as galvanized steel sheet or aluminum alloy sheet wherein several components including facia, flashing and ridge structure are integral. More particularly, each of the facia and flashing members 35 has a normally generally vertical substantially flat facia panel 36 (see FIG. 1) which is integral through a downwardly and outwardly inclined lower drip ledge 37, and a bight 39, with engageable flange means 38 reaching upwardly and inwardly behind the drip ledge 37. A longitudinal ridge 40 having a normally downwardly laterally open groove 41 is provided by an upper portion 36*a* of the facia panel being substantially parallel with a rear upper substantially flat flashing panel 42 and having the portion 36*a* integral with the upper flashing panel 42 through a crest and bight portion 43 of the facia and flashing member 35. The crest and bight portion 43 longitudinally leads generally parallel with the longitudinal lead of the bight 39 and also is generally parallel with an edge 45*a* of a lower flashing lip 45 and generally parallel with an arris 44, having the lower flashing lip 45 integral with the upper flashing panel 42 at arris 44 and downwardly and rearwardly inclined relatively to the upper flashing panel 42.

As will be understood by referring to FIG. 3, that adjacent longitudinal ends of the facia and flashing members 35 are spliced from inside through use of a splice plate 50 which is made of sheet material, such as galvanized steel or aluminum alloy sheet. The splice plate 50 transversely extends from being lapped against the upper flashing panels 42 to being lapped against the flange means 38 of the two facia and flashing members while intermediately transversely being against the inside faces of those members.

A highly important feature of the facia and flashing members 35 and the dam members 17 is had through structurally interrelating these members to enable the facia and flashing members to be installed upon the dam members by lateral application and to have the ridge structure 40 of the facia and flashing members 35 horizontally laterally stabilized by being engaged with the tongue means 24 of the dam means 17 in the installed positions of the facia and flashing members. The facia and flashing members 35 are suited to be placed in longitudinal series over the already installed dam means 17 so as to cover the latter, and so as to have initially the tongue means 24 of the dam or cant means 17 received within the ridge groove 41 in the facia and flashing member, with the facia panel 36 being immediately outside the front panel means 18 of the dam means 17, and with the flashing lip 45 of the facia and flashing member resting upon the sheet roofing 15 in the region where the sheet roofing is against the surface of the lower panel section means 22*b* of the dam means 17, while the outwardly projecting detent means 19 afforded by the dam or cant means 17 is below the flange means 38 of the facia and flashing member 35. Under these conditions, the groove 41 in the ridge 40 of the facia and flashing member 35 leads upward above the end of the tongue means 24 of the dam or cant means 17 and provides tolerance for the ridge 40 to be depressed downwardly in response to thrust applied externally to that ridge, thus moving the flange means 38 of the facia and flashing member 35 to a position which is below the detent means 19 of the dam or cant means 17 and urging the flashing lip 45 of the facia and flashing member against the sheet roofing 15 on the canted lower panel means 22*b* of the dam member 17. Reactive thrust due to resilience of that portion of the facia and flashing member 35 which is rearward of the facia panel 36 thus is stored and is transmitted for raising the flange means 38 into engagement with the detent means 19 after downward external thrust upon the ridge 40 has been diminished or discontinued and while the flashing lip 45 continues to press the sheet roofing 15 onto the canted lower panel means 22*b*. Engagement of the flange means 38 of the facia and flashing member 35 with the detent means of the dam means 17 stops upward movement of the facia and flashing member and is maintained by reactive thrust transmitted from that portion of the facia and flashing member which is rearward of the facia panel 36 while having the flashing lip 45 still pressing the sheet roofing 15 against the canted lower panel means 22*b* of the dam means 17, thereby maintaining the facia and flashing member 35 in an installed position wherein the ridge 40 is horizontally laterally stabilized by being engaged with the tongue means 24 of the dam means 17. In the present embodiment, the sheet roofing 15 is entrapped between the ridge 40 of each of the facia and flashing members 35 and the tongue means 24 of the dam means 17 by being held by the tongue means on both sides of the latter against opposite legs of the ridge 40 in the groove 41. This same connection permits sliding movement of the ridge 40 relatively to the tongue means 24 for the facia and flashing member 35 to be installed and horizontally laterally stabilizes the facia and flashing member 35 through the sheet roofing after the facia and flashing member is installed.

In the embodiment represented in FIG. 4, a facia and flashing means 35' of a conjoint facia, flashing and water dam is similar to that in FIGS. 1 and 3; however, the dam means 17' and the detent means 19' are separate elements. The cant means 17' has a body, such as of wood, provided integrally with tongue means 24', the latter having a longitudinal crest line which is maintained substantially parallel with an edge 19*a'* of the detent means 19'. The detent means 19' is made of sheet material and is suitably attached as a separate element to the wall of the building so as to have the edge 19*a'* substantially parallel to the roof deck 11' and removed a suitable distance from the crest of the tongue means 24' to allow the facia and flashing member or members 35' to be installed in a manner hereinbefore described with reference to FIGS. 1 to 3, and thus allowing the facia and flashing member 35' to be laterally depressed by downward thrust at the ridge 40' for pressing the flashing lip 45' against the sheet roofing 15' on the cant means 17' and then allowing the reactive thrust thus generated in the flashing means to raise the flange means 38' into engagement with the detent means 19' and thereafter maintain installed position of the facia and flashing member 35'. It will also be noted that the sheet roofing 15' on the inclined surface of the cant means 17' terminates short of reaching the tongue means 24' and that the tongue means has lateral surfaces directly against the inner faces of the legs of the ridge 40' for the ridge to be vertically moved slidably relatively to the tongue means, during the installing operations applied to the facia and flashing member 35', and to be laterally stabilized by the tongue means 24' after the facia and flashing member has been installed.

Turning to a further embodiment, represented in FIG. 5, the detail provided associates with a conjoint facia, flashing and water dam structure which in all respects is similar to that which is represented in FIGS. 1 to 3 except that it is the facia and flashing means 35'' which provides ridge tongue structure and it is the dam or cant means 17″ which provides grooved ridge structure to interrelate with sheet roofing 15″ by entrapping the same to permit installation of the facia and flashing means 35″ by lateral movement in a manner hereinbefore described, and for horizontally laterally stabilizing the facia and flashing means 35″ relatively to the dam or cant means 17″ in the installed position of the facia and flashing means.

As the invention lends itself to many possible embodiments and as many possible changes may be made in the embodiments hereinbefore set forth, it will be distinctly understood that all matter described herein is to be interpreted as illustrative and not as a limitation.

I claim:

1. In a conjoint facia, flashing and water dam for being installed on a building adjacent to a wall and roof deck of said building, the combination which includes; facia and flashing means comprising, facia means, flashing means and longitudinal ridge structure interconnecting said facia means and said flashing means to have said facia means laterally extend generally vertically adjacent to said building wall, said facia and flashing means, as installed, being externally laterally re-entrant along the rear of said ridge structure thereof and over said flashing means to have said flashing means extend rearwardly and downwardly from said ridge structure of said facia and flashing means toward said roof deck, and said facia means having engageable means for being detained; and dam and detent means comprising, dam means adapted to extend behind said facia means and including longitudinal ridge structure supported to stay in a substantially fixed position above said roof deck after said dam means has been installed, and said dam means, as installed, being laterally externally re-entrant along the rear of said ridge structure of said dam means and over a surface of said dam means leading rearwardly and downwardly from said ridge structure of said dam means toward said roof deck, said surface of said dam means to support sheet roofing having the latter lead upward from said roof deck and beneath said flashing means for said flashing means pressing upon said sheet roofing to have upward reactive thrust for lifting said ridge structure of said facia and flashing means, and detent means adapted to be connected with said building so as to be in a position below said ridge structure of said dam means, and said ridge structures of said facia and flashing means and said dam means together forming upper tongue and grooved means comprising upper tongue means and upper grooved means and said engageable means and said detent means together including lower tongue and grooved means comprising lower tongue means and lower grooved means, for said facia and flashing means to be moved laterally downwardly onto said dam means having said upper tongue means and said upper grooved means relatively moving stably engaged laterally with one another in each of opposite horizontai directions and thus stabilizing said ridge structure of said facia and flashing means laterally in each of opposite horizontal directions, and thereby causing said flashing means with continued downward movement of said facia and flashing means to press said sheet roofing against said surface of said dam means and store upward reactive thrust and disposing said lower tongue means and said lower grooved means to be upwardly relatively moved, and thereby become engaged, through having said facia and flashing means move upwardly in response to said upward reactive thrust stored in said flashing means, and thus have said upper tongue means and said upper grooved means engaged and relatively moving simultaneously with said lower tongue means and said lower grooved means being engaged and relatively moving and said upward movement of said facia and flashing means eventually stopped by said detent means against said engageable means, with said flashing means thereafter still pressing said sheet roofing against said surface of said dam means, said laterally stably engaged upper tongue means and upper grooved means still stabilizing said ridge structure of said facia and flashing means laterally in each of opposite horizontal directions and said lower tongue means and said lower grooved means remaining engaged.

2. In a conjoint facia, flashing and water dam as set forth in claim 1 wherein said upper tongue means and said upper grooved means, on being engaged, entrap said sheet roofing therebetween, and generally vertically relatively movably form a slip connection with said sheet roofing, whereby said facia and flashing means is horizontally laterally stabilized by said dam means.

3. In a conjoint facia, flashing and water dam as set forth in claim 1 wherein said facia and flashing means is characterized by including at least one facia and flashing member, the latter comprising unitary sheet means including at least in part each said facia means, said flashing means and said longitudinal ridge structure of said facia and flashing means.

4. In a conjoint facia, flashing and water dam as set forth in claim 1 wherein said facia and flashing means is characterized by including at least one facia and flashing member, the latter comprising unitary sheet means including at least in part each said facia means, said engageable means, said flashing means and said longitudinal ridge structure of said facia and flashing means.

5. In a conjoint facia, flashing and water dam as set forth in claim 4 wherein said engageable means of said facia and flashing member is formed by said facia means of said member having a facia panel and generally upwardly directed engagable means concealed behind said panel for said engageable means of said member to be engaged and arrested against upward movement by said detent means.

6. In a conjoint facia, flashing and water dam as set forth in claim 5 wherein a downwardly and outwardly inclined drip edge of said facia panel forms a bight with flange means, having said flange means inclined upwardly and inwardly to receive said detent means from behind said drip edge.

7. In a conjoint facia, flashing and water dam as set forth in claim 1 wherein said dam means is characterized by including at least one dam member, the latter comprising unitary sheet means including at least in part said ridge structure of said dam means interconnecting a normally generally vertical panel, said generally vertical panel to be secured to said building wall, and a rearwardly and downwardly leading panel, said rearwardly and downwardly leading panel to form at least in part said surface for supporting said sheet roofing under said flashing means, and flange means connected with said rearwardly and downwardly leading panel, said flange means to be secured to said roof deck.

8. In a conjoint facia, flashing and water dam as set forth in claim 1 wherein said facia and flashing means is characterized by including at least one facia and flashing member, the latter comprising unitary sheet means including at least in part each said facia means, said engageable means, said flashing means and said ridge structure of said facia and flashing means, and said dam means is characterized by including at least one dam member which comprises unitary sheet means including at least in part said ridge structure of said dam means interconnecting a normally generally vertical panel, said generally vertical panel to be secured to said building wall, and a rearwardly and downwardly leading panel, said rearwardly and downwardly leading panel to form at least in part said surface of said dam means for supporting sheet roofing under said flashing means, and flange means connected with said rearwardly and downwardly leading panel, said flange means to be secured to said roof deck.

9. In a conjoint facia, flashing and water dam as set forth in claim 8 wherein said detent means in said conjoint facia, flashing and water dam includes generally downwardly directed projecting means integral with said normally generally vertical panel of a related said at least one dam member, and said engageable means of a related said at least one facia and flashing member is formed integral with a facia panel of said facia and flashing member and is generally upwardly directed leading behind said facia panel to be engaged and arrested against upward movement by said projecting means of said dam member.

10. In a conjoint facia, flashing and water dam as set forth in claim 1 wherein said upper tongue and grooved means includes normally downwardly laterally open grooved means formed by said ridge structure of said facia and flashing means and normally upwardly projecting tongue means formed by said ridge structure of said dam means for said upwardly projecting tongue means to be engaged with said downwardly laterally open grooved means of said facia and flashing means.

11. In a conjoint facia, flashing and water dam as set forth in claim 9 wherein a downwardly and outwardly inclined drip edge of said facia panel is integral with said engageable means of said facia and flashing member, having said engageable means of said facia and flashing member inclined upwardly and inwardly to receive said projecting means of said dam means from behind said drip edge.

12. In a conjoint facia, flashing and water dam as set forth in claim 1 wherein said upper tongue and grooved means includes normally downwardly projecting tongue means formed by said ridge structure of said facia and flashing means, and normally upwardly laterally open grooved means formed by said ridge structure of said dam means for being engaged with said downwardly projecting tongue means.

* * * * *